US007478744B2

(12) United States Patent
Maffei

(10) Patent No.: US 7,478,744 B2
(45) Date of Patent: Jan. 20, 2009

(54) BOX SHAPED CONTAINER MADE OF CARDBOARD OR SIMILAR MATERIAL WITH ASSOCIATED CURSOR

(75) Inventor: Camilla Maffei, Pistoia (IT)

(73) Assignee: Project S.a.s di Massimo Memichelli & C., Pistoia (IT)

( * ) Notice: Subject to any disclaimer, the term of this patent is extended or adjusted under 35 U.S.C. 154(b) by 558 days.

(21) Appl. No.: 11/151,009

(22) Filed: Jun. 13, 2005

(65) Prior Publication Data

US 2005/0274783 A1 Dec. 15, 2005

(30) Foreign Application Priority Data

Jun. 15, 2004 (IT) ..... FI2004A0137

(51) Int. Cl.
*B65D 25/04* (2006.01)
*B65D 43/12* (2006.01)
*B65D 43/20* (2006.01)

(52) U.S. Cl. ..... 229/220; 229/125.12; 229/129.1; 206/831

(58) Field of Classification Search ..... 229/220, 229/129.1, 125.12; 220/345.1; 206/468, 206/831, 815

See application file for complete search history.

(56) References Cited

U.S. PATENT DOCUMENTS

| | | | | |
|---|---|---|---|---|
| 4,197,985 | A * | 4/1980 | Austin | 229/220 |
| 4,609,142 | A * | 9/1986 | Adamek | 229/220 |
| 5,505,373 | A * | 4/1996 | von Stillfried | 229/129.1 |
| 5,875,962 | A * | 3/1999 | Jørgensen-Beck et al. | 229/220 |

FOREIGN PATENT DOCUMENTS

| | | |
|---|---|---|
| EP | 0 970 433 B1 | 1/2000 |
| IT | 1278671 | 5/1995 |

* cited by examiner

*Primary Examiner*—Nathan J Newhouse
*Assistant Examiner*—Christopher Demeree
(74) *Attorney, Agent, or Firm*—McGlew & Tuttle, P.C.

(57) ABSTRACT

A shaped box, made of cardboard or similar material, suitable for packaging products such as medicines, wherein the precut cardboard forming the box comprises an additional precut layer (35) to define a cursor (35A) attached on the inside of one wall (27) of the box, from which one (17) of the folding flaps (17, 15) for closing said box extends; said cursor (35A) has a tab (L) that remains folded back so as to follow both said closing flap (17) and an extension (P) of said additional layer (35), thus being glued to the inside of said folding flap (17).

20 Claims, 5 Drawing Sheets

X
VIII
IX
7
19
F
27A
F1
L
27
27B
13
30
11
17
35A
35
39
39A
23
28
9
29
24
L'
P

BOX SHAPED CONTAINER MADE OF CARDBOARD OR SIMILAR MATERIAL WITH ASSOCIATED CURSOR

This invention refers to an improved form of box shaped container, generally made of cardboard or similar material, that—combined with the box—includes a cursor or sliding tab suitable for various uses, and particularly for enabling information printed on the cursor to be brought into view in windows cut into one side of the box. A means for achieving this is described in the patents IT 1,278,671 and EP 0,970,433.

An object of the invention is to produce a box that, from the point of view of the papermaking technology, is even easier to make than those described in the aforesaid patents using known systems and exploiting the functions thereof, and that also enables larger useful areas to be provided on said cursor. This and other objects and advantages will become evident from the following description.

To be more precise, the invention refers to a precut sheet forming a box that includes an additional precut layer to define a cursor, which remains attached to said layer by means of weak links that can be broken when a sliding action is exerted on said cursor.

According to the present invention, said additional layer is attached to the inside of one wall of the box, from where one of the folding flaps for closing the box extend; a window is cut partly in said wall and partly in said closing flap; moreover, said cursor has a tab in line with said window, which remains folded back to follow said closing flap, and can be folded inwards against said cursor so as to provide a grip for extracting the cursor; along the fold dividing it from the wall, said closing flap has a slot for enabling the extraction of said cursor.

The additional layer advantageously presents an extension that is glued to the inside of said folding flap and also has a slot along its own folding line coinciding with the slot in the folding flap, and said tab is defined in said extension by means of a perforated line that is torn the first time said tab is folded back inside and against said cursor to enable the latter's extraction.

The invention can be better explained and its numerous objects and advantages will become clearer to a person skilled in the art by referring to the schematic drawings attached, which illustrate a practical non-restrictive example of the invention.

Figure 1:
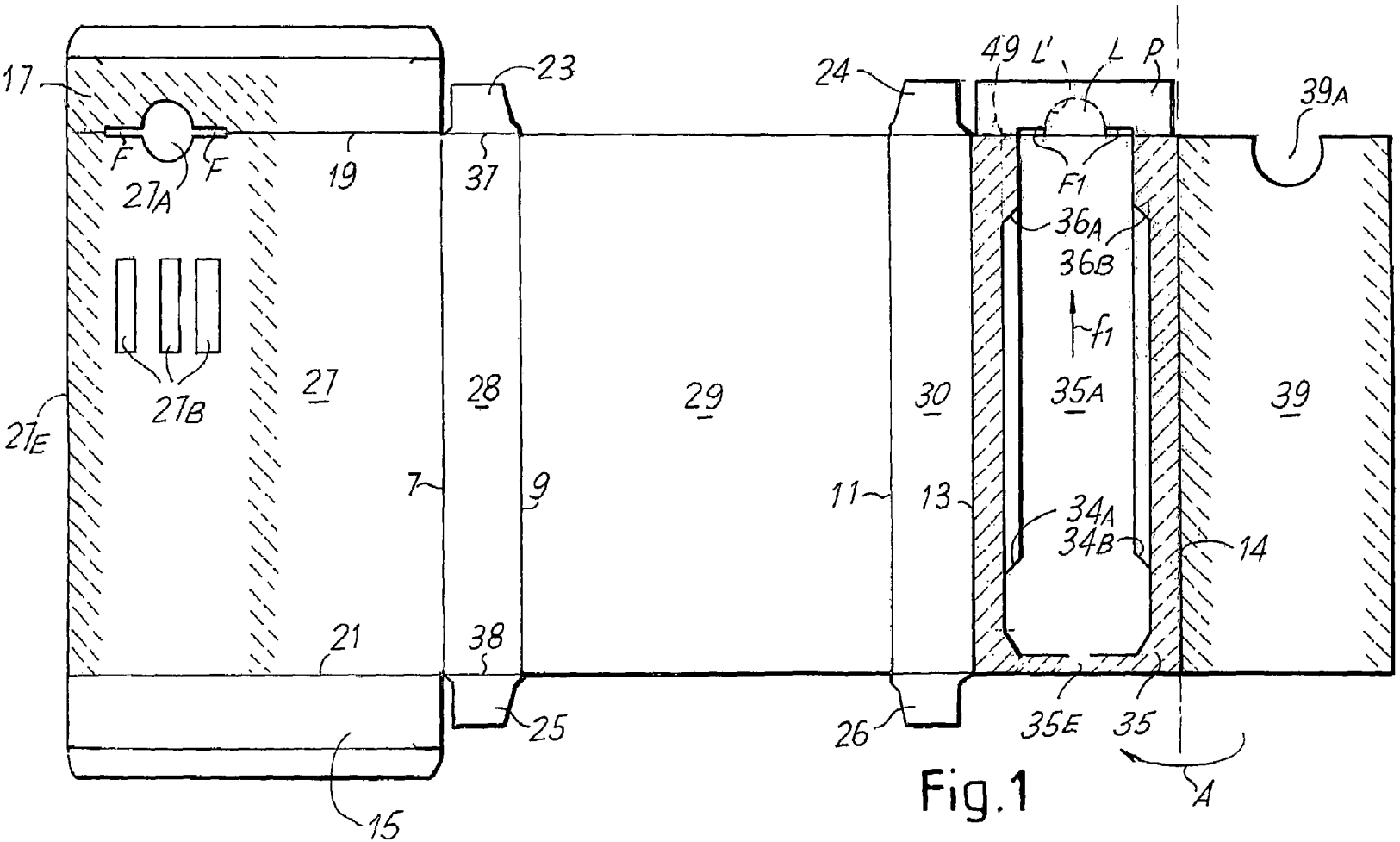
FIG. 1 shows the layout of a precut sheet for making one possible embodiment of the invention.

According to the illustrations in the drawings, wherein the same numbers are used to indicate the same parts in all the various figures, a precut sheet mainly presents four areas forming the side walls of the container and indicated respectively by the numerals 27, 28, 29 and 30 (see FIG. 1); said walls are separated by folding lines, respectively 7, 9, 11 and 13, extending along the longitudinal edges of the container. Beyond to said folding line 13, there is also an additional layer 35 and, separated by a folding line 14, an extra thickness 39.

Said side or wall 27 has at least one flap 17 or—as illustrated in the drawing—two opposite flaps 15 and 17—separated from said wall 27 by folding lines 19 and 21—to form the end walls of the container, at least one of which can be opened and closed to access the inside of the box.

A window 27A is cut partly in said wall 27 and partly in said closing flap 17; moreover, said closing flap 17 advantageously has a slot F along said folding line 19 in line with said window 27A.

At least one window 27B is cut on the surface of said wall 27.

Said wall 28 has flaps 23 and 25 that can be folded along folding lines 37 and 38 to cooperate with the closing of the ends of the box. The folding line 9 separates said wall 28 from said wall 29, the wall 30, separated from said wall 29 by means of the folding line 11, has another two flaps 24 and 26 to cooperate with the closing of the ends of the box.

Beyond the folding line 13 there is also an additional layer 35, wherein a cursor 35A is cut but remains connected to said layer 35 by means of at least one weak link 35E, which is torn when a sliding action is exerted in the direction of the arrow f1 on the portion forming said cursor 35A.

Said cursor 35A has stops 34A and 34B suitable for cooperating with stops 36A and 36B created in said additional layer 35 to prevent the cursor from being extracted completely.

Moreover, said additional layer 35 has an extension P, a slot F1 along the folding line 49 of said extension P, and a perforated line L' defining a tab L, that forms an integral part of the cursor 35A and that is used to facilitate the sliding extraction of the cursor 35A in the direction f1.

Said extra thickness 39 that extends beyond said folding line 14, advantageously presents an indentation 39A.

The shape of said precut sheet and the creation of said cursor enable—in a substantially automated manner using equipment of substantially conventional type—all the actions required for the production of the described box, actions that essentially equivalent to those required to produce a conventional box. The gluing operations are also substantially equivalent to those involved in the production of a conventional box.

The above-described precut sheet is folded along said folding lines and glued together with glue distributed on the hatched areas of FIG. 1, at least on the thickness 39 and the wall 27, and possibly also on the additional layer 35 (but not on the area of the cursor 35A). This gluing is done in successive stages, as illustrated in the example shown in FIGS. 2 to 4.

Figure 2:
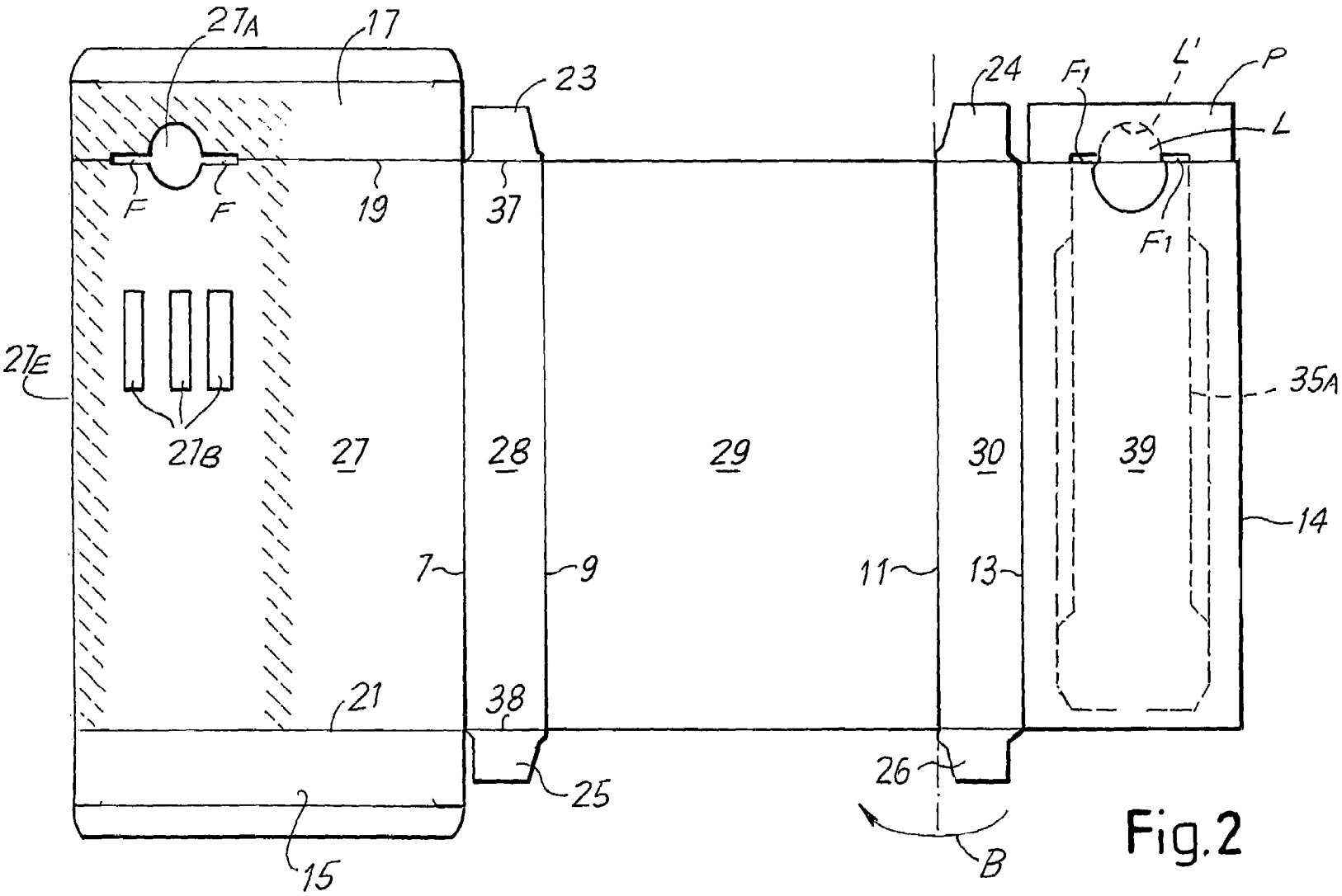
FIGS. 2, 3 and 4 show views from above of the subsequent stages for folding the precut sheet of FIG. 1 to form a container.

To be more specific, FIG. 2 shows said extra thickness 39 on the precut sheet of FIG. 1 folded—see arrow A in FIG. 1—along said folding line 14 and pressed up against said additional layer 35, gluing together the hatched areas of the additional layer 35 and/or of the extra thickness 39, as shown in FIG. 1.

Figure 4:
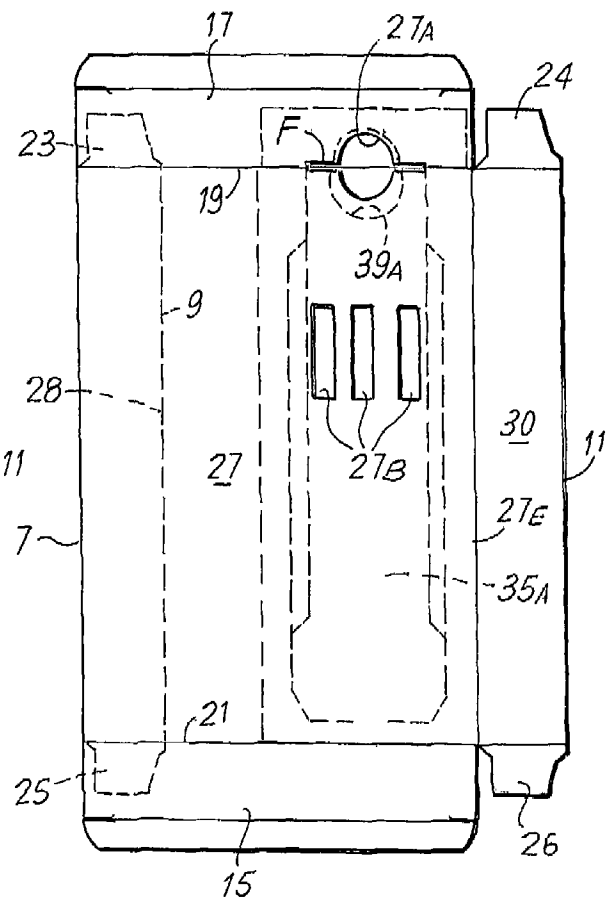
Figure 3:
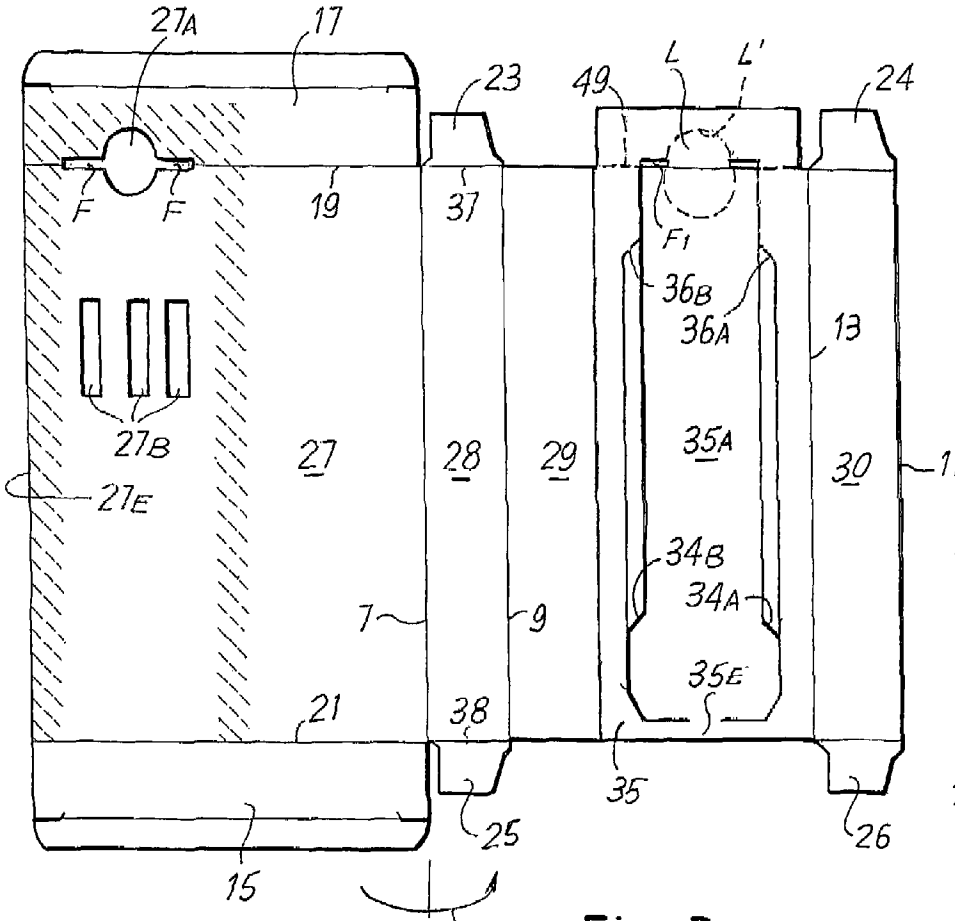

FIG. 3 shows the folding—see arrow B in FIG. 2—of said overlapping and glued layer 35 and thickness 39 and of the wall 30 along said folding line 11 to rest on the wall 29. FIG. 4 shows the folding of the wall 27 (see arrow C in FIG. 3) along the folding line 7 and the gluing together of the hatched areas—see FIGS. 1 to 3—of said wall 27 and said additional layer 35, by means of the glue distributed in the hatched area on the wall 27.

From the above description, it is clear that the additional layer 35 comes to be between said wall 27 and said extra thickness 39, thus forming a pocket or sheath wherein said cursor 35A obtained from said layer 35 can slide.

Figures 5, 6, 7:
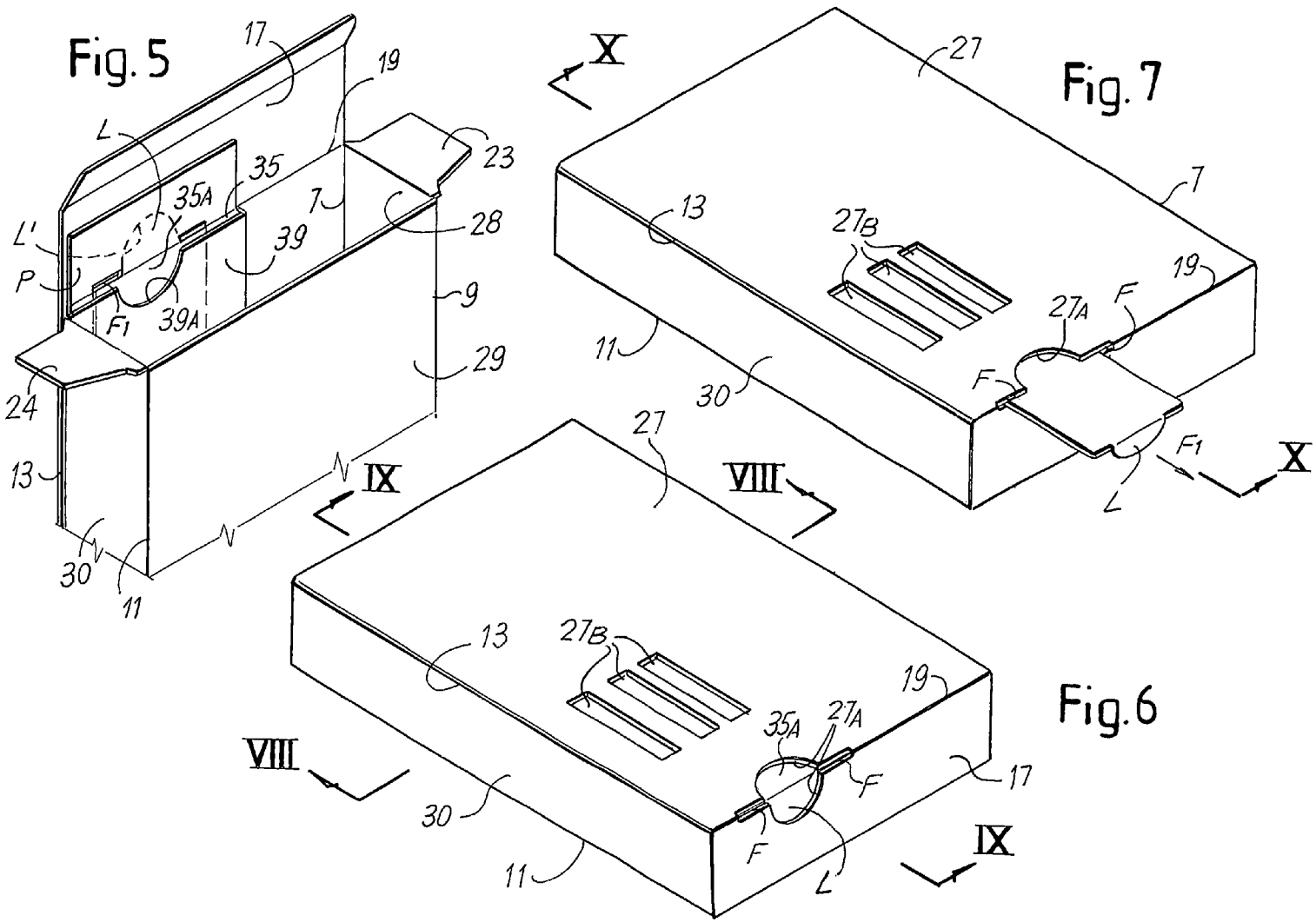
FIG. 5 shows a perspective view of the shaped box of FIG. 4, folded into the final arrangement with the end flaps open.
FIG. 6 shows a perspective view of the box of FIG. 5 but closed.
FIG. 7 shows a perspective view of the closed box of FIG. 6, with the cursor partly extracted.

FIG. 5 shows a perspective view of the box in FIG. 1 assembled and folded into three-dimensional shape with the flaps 23, 24 and 17 partly open, so as to show said pocket or sheath created by said extra thickness 39 and by said wall 27, wherein said additional layer 35 forms the cursor 35A; note also said extension P, which is glued inside said flap 17.

The previously-mentioned indentation 39A, created in said extra thickness 39, lies in line with the tab L obtainable from the extension P, and said tab L comes to be in line with the window 27A. This facilitates the grip on said cursor 35A starting from the closed configuration of FIG. 6.

FIG. 6 shows a perspective view of the box of FIG. 5, assembled and closed, wherein said tab L, in line with said window 27A, remains folded back in the closed configuration, because it follows said closing flap 17 together with the extension P (which is glued to the inside of the flap 17).

Moreover, along the folding line 19 in line with said window 27A, said closing flap 17 has the slot F, which substantially coincides with the slot F1 coming between the cursor 35A and the extension P, thus enabling the extraction of the cursor 35A. The one or more windows 27B in the wall 27 enable(s) the information contained on said cursor 35A to be brought into view.

FIG. 7 shows a perspective view of the box of FIG. 6, assembled, closed and with said cursor 35A partly extracted from said slots F on the folding line 19, corresponding to said slot F1 created in said folding line 49. The tab L can be advantageously folded inwards towards said cursor 35A, so as to offer a grip for extracting said cursor.

Figure 11:
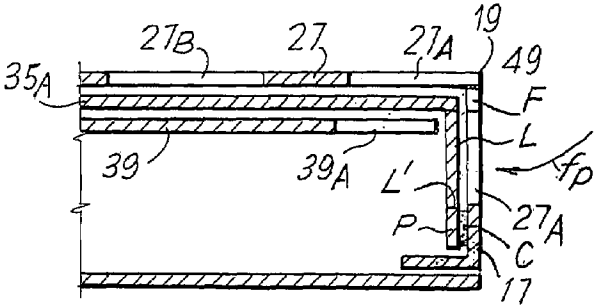
FIGS. 11 and 12 show enlarged details of FIGS. 9 and 10.
Figure 9:
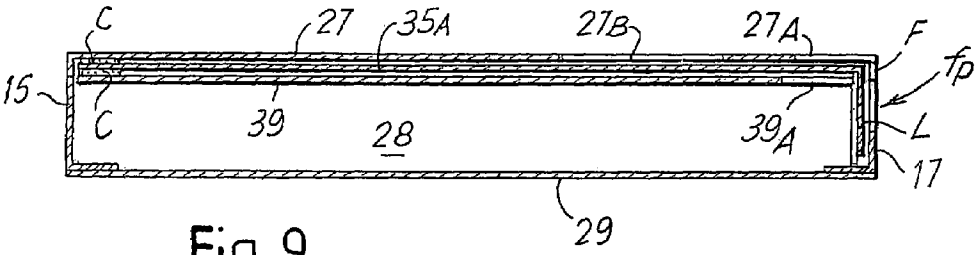
Figure 10:
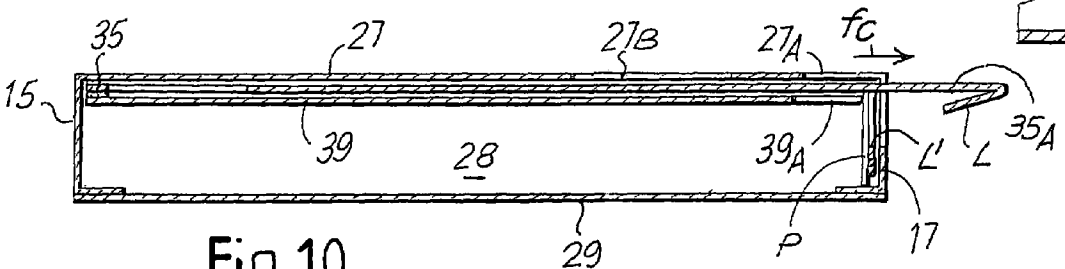
FIG. 10 shows a cross-section along X-X of FIG. 7.

When the flap 17 is closed, the tab L (connected along the perforated line L' to the extension P glued to said flap) follows said flap 17, so the box is closed as illustrated in FIGS. 6, 9 and 11.

Figure 8:
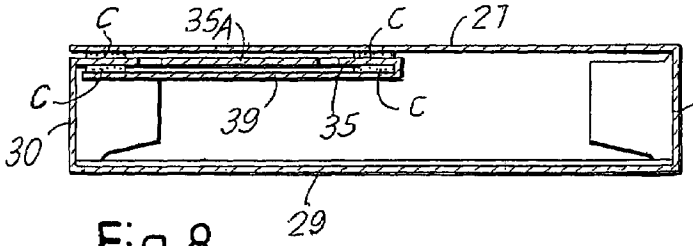
FIGS. 8 and 9 show cross-sections respectively along VIII-VIII and IX-IX of FIG. 6.

FIG. 8 shows a cross-section along VIII-VIII of FIG. 6, where the glue joining the various parts of the precut sheet is schematically represented by the letter C. FIG. 8 also shows said cursor 35A, formed by said additional layer 35, contained in said pocket or sheath between the extra thickness 39 and the wall 27.

FIG. 9 shows a cross-section along IX-IX of FIG. 6, wherein said cursor 35A can be seen contained inside said pocket or sheath between said extra thickness 39 and said wall 27; the tab L, formed in said extension P, is folded back in its closed configuration to follow said closing flap 17 to which the extension P is glued.

Figure 12:
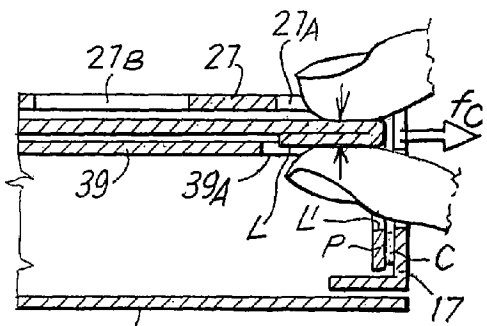

When the cursor 35A is first extracted, by pulling on the tab L in the direction of the arrow fP (FIGS. 9 and 11), said tab is torn from the extension P along the line L' and the first inward fold against said cursor 35A is obtained so as to offer a grip in the direction of the two opposite arrows shown in FIG. 12, to allow for the partial manual extraction of said cursor 35A along fC, to bring its content into view through the window(s) 27B.

When the cursor 35A is pushed back in, the "memory" effect of the cardboard material makes the tab L tend to return to the position coplanar to the extension P and almost surfacing from the flap 17, which nonetheless remains closed and the box remains sealed.

Subsequent extractions, viewings and re-insertions can be repeated both with the box still sealed and after the box has been opened, with the flap 17 preferably in the closed position.

It will be evident from the above description that the cursor 35A is positioned in line with one wall, e.g. 27, which offers a very ample front of a relatively very flat box, from which a closing flap such as 17 is generally formed; the cursor 35A can consequently be very wide and contain far more information than can be contained in a cursor made on a side such as walls 28 and 30, as suggested in the previous patents quoted at the beginning of the present description.

Clearly, what has been described and illustrated represents just one possible non-restrictive embodiment of the invention, which may vary in shape and arrangement without departing from the concept behind the invention. Any use of reference numbers in the attached claims serve exclusively for the purpose of facilitating a reading in the light of the preceding description and of the attached drawings, without restricting the scope of the patent in any way.

What I claim is:

1. A box shaped container made of cardboard or similar material, suitable for packaging products such as medicines, the container comprising:

a precut sheet forming a box structure, said precut sheet including an additional layer precut to define a cursor, said cursor being connected to said additional layer via weak links, said cursor being disconnected from said additional layer when a sliding action is exerted upon said cursor, said additional layer being attached to an inner surface of one wall of the box structure, wherein one or more folding closing flaps extend from said wall for closing the box structure, wherein a portion of said wall and a portion of said closing flap define a window, said cursor having a tab coinciding with said window, said tab being in a folded position such that said tab is adjacent to said closing flap, said tab being foldable from said folded position to a folded back position, said tab engaging said cursor to define a grip for extracting the cursor, said closing flap defining a slot for extracting said cursor, said slot extending along a fold joining said closing flap to the wall.

2. Container according to claim 1, wherein said additional layer has an extension, said extension being glued to an inner surface of said folding flap, said extension having an extension slot, said extension slot coinciding with the slot in the folding flap, said extension slot extending along a fold of said extension, said tab being defined in said extension via a perforated line, said perforated line being torn when said tab is folded inwards and against said cursor in said folded back position.

3. Container according to claim 1, wherein said additional layer is included between said wall and an extra thickness, which is part of the precut shape and forms a pocket or sheath with said wall wherein said cursor can slide.

4. Container as in claim 2, wherein said additional layer is included between said wall and an extra thickness, which is part of the precut shape and forms a pocket or sheath with said wall wherein said cursor can slide.

5. Container according to claim 3, wherein said wall and said extra thickness are respectively glued onto the two opposite sides of said additional layer, on the side of said cursor.

6. Container according to claim 1, wherein said precut sheet includes at least one window cut in said wall adjacent to said cursor.

7. Container according to claim 1, wherein said additional layer is defined adjacent to a wall of the box, beyond a folding line.

8. Container according to claim 1, wherein said cursor has stops for intercepting respective stops formed in said additional layer.

9. Container according to claim 1, wherein said extra thickness has an indentation in an area of said tab and coinciding with said tab.

10. Container according to claim 9, wherein said tab, which is created in said extension, is in said folded position when said closing flap is in a closed position and wherein said tab coincides with said indentation when said tab is in said folded back position.

11. Container according to claim 1, wherein said tab is solidly attached to said extension and coincides with the portion of window cut in said closing flap, said tab being disconnected from said extension when said tab is in said folded back position.

12. Container according to claim 1, wherein said tab is disconnected from an extension of said additional layer along a perforated line and folded inwards against said cursor to said folded back position when said cursor is extracted from said box structure.

13. A box shaped container made of cardboard or similar material, suitable for packaging products such as medicines, the container comprising:

a precut sheet including an additional layer precut to define a cursor, a first wall having one or more closing flaps extending therefrom, a second wall, a third wall, a fourth wall and an additional wall, said precut sheet being folded such that said first wall is opposite said third wall, said second wall is opposite said fourth wall, said additional wall is opposite said additional layer and said additional layer is attached to an inner surface of said first wall, whereby said precut sheet forms a box structure, said cursor being movable from a connected position to a disconnected position, said cursor being disconnected from said additional layer in said disconnected position, said cursor being connected to said additional layer via weak links in said connected position, wherein a portion of said first wall and a portion of one of said closing flaps define a window, said cursor having a tab disposed opposite said window, said tab being in a folded position, said tab being movable from said folded position to a folded back position, said tab engaging said cursor in said folded back position to define a grip extraction means for extracting said cursor, said closing flap defining a slot, said slot being in communication with said window, said slot extending along a fold line located between said one or more closing flaps and said first wall, wherein a portion of said cursor extends through said slot and said window when said cursor is in said disconnected position and said tab is in said folded back position.

14. Container according to claim 13, wherein said first wall and said additional layer form a cursor receiving space, said cursor being located within said cursor receiving space when said cursor is in said connected position.

15. Container according to claim 13, wherein said tab has a shape corresponding to a shape of a portion of said window defined by said portion of one of said closing flaps.

16. Container according to claim 13, wherein said additional layer has an extension, said extension being attached to an inner surface of one of said closing flaps, said extension having an extension slot, said extension slot being in communication with the slot in said one or more closing flaps, said extension slot extending along a fold of said extension, said tab being defined in said extension via a perforated line, said tab being disconnected from said extension along said when said tab is in said folded back position.

17. Container according to claim 13, wherein said first wall includes at least one window space located adjacent to said cursor.

18. Container according to claim 13, wherein one end of said additional wall has an indentation located in an area of said tab, said indentation coinciding with said tab.

19. Container according to claim 13, wherein said cursor has cursor stops, said additional layer having additional layer stops, said cursor stops engaging said additional layer stops when said cursor is in said disconnected position.

20. A box shaped container made of cardboard or similar material, suitable for packaging products such as medicines, the container comprising:

a box structure including an additional layer precut to define a cursor, a first wall having one or more closing flaps extending therefrom, a second wall, a third wall, a fourth wall and an additional wall, said first wall being located opposite said third wall, said second wall being located opposite said fourth wall, said additional wall being located opposite said additional layer, said additional layer being attached to an inner surface of said first wall, said cursor being movable from a connected position to a disconnected position, said cursor being disconnected from said additional layer in said disconnected position, said cursor being connected to said additional layer via weak links in said connected position, wherein a portion of said first wall and a portion of one of said closing flaps define a window, said cursor having a tab disposed opposite said window, said tab being in a folded position, said tab being moveable from said folded position to a folded back position, said tab engaging said cursor in said folded back position to define a grip extraction means for extracting said cursor, said closing flap defining a slot, said slot being in communication with said window, said slot extending along a fold line located between said one or more closing flaps and said first wall, wherein a portion of said cursor extends through said slot when said cursor is in said disconnected position and said tab is in said folded back position.

* * * * *